US012442609B2

(12) United States Patent
Dwyer et al.

(10) Patent No.: US 12,442,609 B2
(45) Date of Patent: Oct. 14, 2025

(54) SYSTEMS FOR MANAGING AN ENERGY STORE AT A GUN

(71) Applicant: Biofire Technologies Inc., Broomfield, CO (US)

(72) Inventors: Benjamin William Dwyer, Golden, CO (US); Samuel James Farmer, Broomfield, CO (US); Sara Elizabeth Falcone, Lafayette, CO (US); Bryan Edward Rogers, Aurora, CO (US)

(73) Assignee: Biofire Technologies Inc., Broomfield, CO (US)

( * ) Notice: Subject to any disclaimer, the term of this patent is extended or adjusted under 35 U.S.C. 154(b) by 5 days.

(21) Appl. No.: 18/333,206

(22) Filed: Jun. 12, 2023

(65) Prior Publication Data

US 2023/0400274 A1 Dec. 14, 2023

Related U.S. Application Data

(60) Provisional application No. 63/366,322, filed on Jun. 13, 2022.

(51) Int. Cl.
*F41A 19/59* (2006.01)
*F41A 17/06* (2006.01)

(52) U.S. Cl.
CPC ..... *F41A 19/59* (2013.01); *F41A 17/066* (2013.01)

(58) Field of Classification Search
CPC ..... F41A 17/06; F41A 17/066; F41A 19/58; F41A 19/59; F41A 19/60
USPC ..... 42/69.02
See application file for complete search history.

(56) References Cited

U.S. PATENT DOCUMENTS 2,383,088 A * 8/1945 Shaw ..... F41A 19/59 89/135
4,120,017 A * 10/1978 Sickles ..... H02M 3/3381 361/228
4,835,621 A * 5/1989 Black ..... H04N 5/765 386/358
5,355,608 A * 10/1994 Teetzel ..... F42B 3/113 42/117
5,465,518 A * 11/1995 Blaser ..... F41A 19/41 42/70.08
6,354,033 B1 * 3/2002 Findley ..... F41A 19/58 42/70.11
6,370,806 B1 * 4/2002 Klebes ..... F41A 19/58 42/84

(Continued)

*Primary Examiner* — Troy Chambers
*Assistant Examiner* — Benjamin S Gomberg
(74) *Attorney, Agent, or Firm* — Perkins Coie LLP; Andrew T. Pettit

(57) ABSTRACT

The present disclosure provides systems and techniques for managing an energy store at a gun. The gun may include an energy store management system for securing an energy store, such as a battery pack, within a cavity of the gun. The energy store management system may include a dense brace located at a lower end of the cavity, a compressible brace located at an upper end of the cavity, a lid, a gasket at the upper end of the cavity, and a hinge mechanism configured to close the lid such that the lid forms a seal with the gasket. The interior surface of the cavity may be tapered such that the frictional load between the surface of the energy store and the surface of the cavity is higher at the lower end of the cavity than at the upper end of the cavity.

20 Claims, 11 Drawing Sheets

200

(56) References Cited

U.S. PATENT DOCUMENTS

| | | | | |
|---|---|---|---|---|
| 6,449,892 | B1 * | 9/2002 | Jenkins | F41G 1/46 42/106 |
| 6,626,165 | B1 * | 9/2003 | Bhogal | F41A 19/59 124/76 |
| 9,404,699 | B1 * | 8/2016 | Barido | G05B 15/02 |
| 2002/0069570 | A1 * | 6/2002 | Lee | F41A 7/08 42/70.11 |
| 2013/0145670 | A1 * | 6/2013 | Kuhlman | F41A 19/59 42/84 |
| 2013/0234657 | A1 * | 9/2013 | Sun | H02J 50/10 320/108 |
| 2016/0054081 | A1 * | 2/2016 | Creed | F41A 17/46 42/70.06 |
| 2018/0216909 | A1 * | 8/2018 | Thomann | F41H 9/10 |
| 2019/0331448 | A1 * | 10/2019 | Murphy, II | F41C 23/16 |
| 2019/0376755 | A1 * | 12/2019 | Teetzel | G06V 40/197 |
| 2023/0168056 | A1 * | 6/2023 | Galie | F41A 17/06 42/69.03 |

* cited by examiner

100

200

400

600

800

1000

1100

SYSTEMS FOR MANAGING AN ENERGY STORE AT A GUN

CROSS-REFERENCE TO RELATED APPLICATIONS

This application claims priority to U.S. Provisional Application No. 63/366,322, titled "SYSTEMS FOR MANAGING AN ENERGY STORE AT A GUN" and filed on Jun. 13, 2022, which is incorporated by reference herein in its entirety.

FIELD OF TECHNOLOGY

The teachings disclosed herein generally relate to guns, and more specifically to managing an energy store in a gun.

BACKGROUND

The term "gun" generally refers to a ranged weapon that uses a shooting tube (also referred to as a "barrel") to launch solid projectiles, though some instead project pressurized liquid, gas, or even charged particles. These projectiles may be free flying (e.g., as with bullets), or these projectiles may be tethered to the gun (e.g., as with spearguns, harpoon guns, and electroshock weapons such as TASER® devices). The means of projectile propulsion vary according to the design (and thus, type of gun), but are traditionally effected pneumatically by a highly compressed gas contained within the barrel. This gas is normally produced through the rapid exothermic combustion of propellants (e.g., as with firearms) or mechanical compression (e.g., as with air guns). When introduced behind the projectile, the gas pushes and accelerates the projectile down the length of the barrel, imparting sufficient launch velocity to sustain it further towards a target after exiting the muzzle.

Most guns use compressed gas that is confined by the barrel to propel the projectile up to high speed, though the term "gun" may be used more broadly in relation to devices that operate in other ways. Accordingly, the term "gun" may not only cover handguns, shotguns, rifles, single-shot firearms, semi-automatic firearms, and automatic firearms, but also electroshock weapons, light-gas guns, plasma guns, and the like.

Significant energies have been spent developing safer ways to use, transport, store, and discard guns. Gun safety is an important aspect of avoiding unintentional injury due to mishaps like accidental discharges and malfunctions. Gun safety is also becoming an increasingly important aspect of designing and manufacturing guns. While there have been many attempts to make guns safer to use, transport, and store, those attempts have had little impact.

SUMMARY

The systems, apparatuses, and techniques described herein support managing an energy store at a gun. The term "gun," as used herein, may be used to refer to a lethal force weapon, such as a pistol, a rifle, a shotgun, a semi-automatic firearm, or an automatic firearm; a less-lethal weapon, such as a stun-gun or a projectile emitting device; or an assembly of components operable to selectively discharge matter or charged particles, such as a firing mechanism.

Generally, the systems and techniques described herein provide a mechanism for managing an energy store in a gun. The gun may include a trigger that is operable to cause the gun to propel a projectile through a barrel, a cavity, a dense brace located proximate to a lower end of the cavity, and a compressible brace located proximate to an upper end of the cavity. The compressible brace may apply force onto the energy store such that the energy store is held in a static position between the compressible brace and the dense brace. The size of the dense brace may be configured such that an electrical contact of the energy store contacts a corresponding electrical contact of the gun while mitigating potential damage to the electrical contact of the energy store or the electrical contact of the gun. As an example, the compressible brace may be designed to hold the energy store against the dense brace in a secure fashion, and the dense brace may be designed such that electrical contacts of the energy store contact electrical contacts of the gun while the energy store is being held between the compressible brace and the dense brace. The systems described herein therefore provide a reliable electrical connection between the energy store and the gun.

Figure 1:
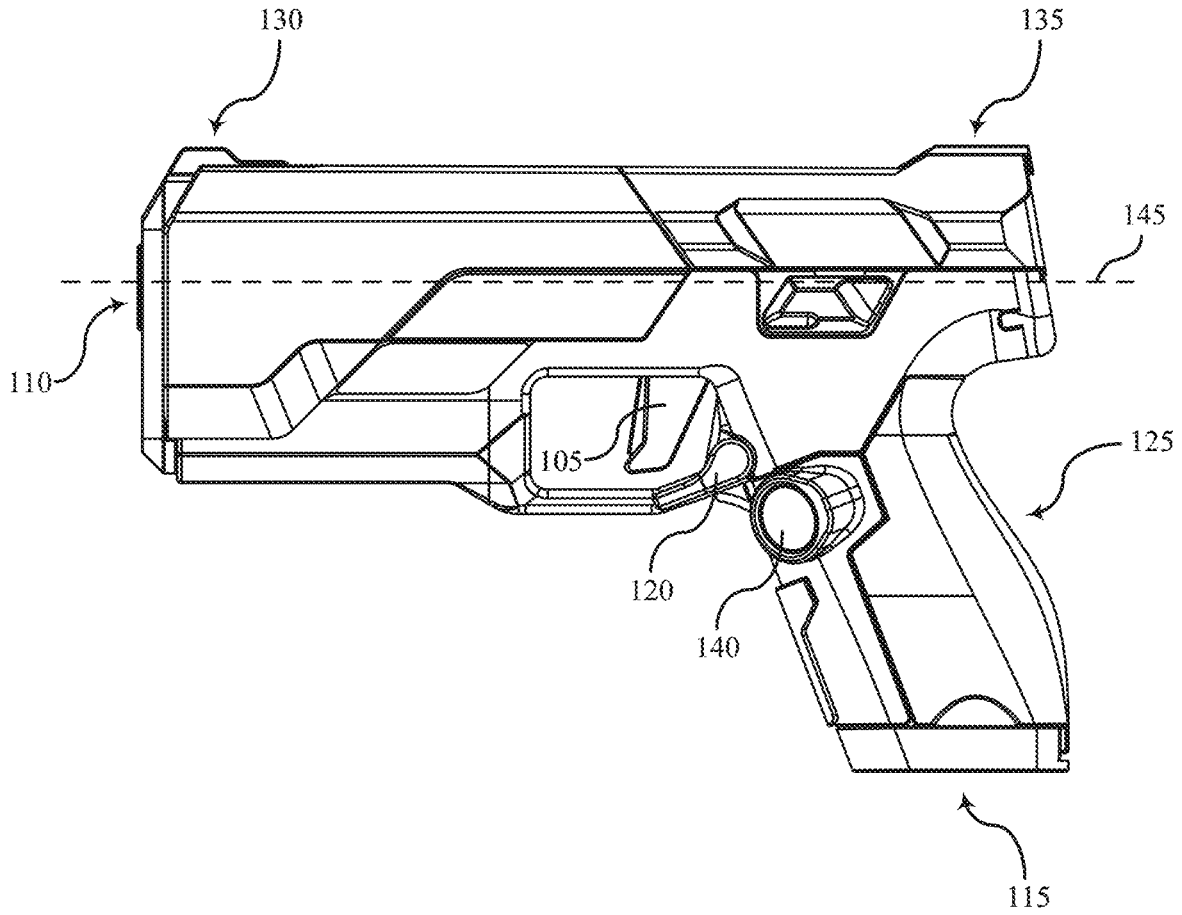
FIG. 1 illustrates an example of a gun that is capable of managing an energy store.

Various features of the technology described herein will become more apparent to those skilled in the art from a study of the Detailed Description in conjunction with the drawings. Various embodiments are depicted in the drawings for the purpose of illustration. However, those skilled in the art will recognize that alternative embodiments may be employed without departing from the principles of the technology. Accordingly, the technology is amenable to modifications that may not be reflected in the drawings.

DETAILED DESCRIPTION

A gun may include an energy store that is used to power various aspects of the gun, such as a laser or an electronic sensor. The energy store may store energy in the form of electrical energy, chemical energy, nuclear energy, or mechanical energy. For example, a capacitor may store electrical energy, and a battery or fuel cell may store chemical energy. Managing an energy store in the context of guns, such as an electromechanical gun, can be particularly challenging since the energy store is exposed to extreme forces and contaminants, such as recoil force and carbon fouling. Additionally, the energy store may power multiple components of the gun, so a large capacity energy store may be desired.

Conventional systems for managing energy stores fail to account for the conditions associated with the gun, such as the forces and contaminants associated with firing projectiles from the gun. Further, conventional systems fail to provide a reliable connection between electrical contacts, and the lack of a reliable connection between electrical contacts can result in power outages or even inoperability of the gun. For example, conventional guns fail to provide a system for managing a large capacity battery pack, such as a battery pack with a capacity of 100 milliamp-hours (mAh) or more.

Introduced here, therefore, are systems and techniques for managing an energy store in a gun. The systems and techniques described herein facilitate a reliable connection between electrical contacts of the energy store and corresponding electrical contacts of the gun while mitigating interference caused by contaminants. The systems described herein also support recharging and replacing the energy store in a rapid fashion. The energy store may provide power to one or more aspects of the gun, and the systems described herein facilitate a robust and reliable connection between the energy store and the gun. For example, energy from the energy store may be used to disengage a safety mechanism, displace an actuator, or fire a projectile from the gun. As another example, energy from the energy store may be used to power a processor, a flashlight, a laser, a haptic motor, an electronic sensor, or the like.

The systems described herein can be used to retain and selectively release an energy store in a gun. The systems may include a tapered cavity, a compressible brace, a dense brace, a retainer, an ejector, and a lid. The lid may include a gasket that seals the opening of the cavity and prevents contaminants from entering the cavity. Aspects of an energy store management system work in a complementary fashion to facilitate easy insertion and removal of an energy store (e.g., a battery or a battery pack) while handling recoil forces and contaminants associated with operating the gun in various environments. The energy store management systems described herein facilitate the reliable connection between the energy store and the gun by ensuring the energy store is consistently positioned in a location that allows energy to be transferred from the energy store to the gun. For example, the energy store may include contacts that are configured to transfer energy across corresponding contacts of the gun, and the systems described herein facilitate the reliable and repeatable positioning of the energy store such that the contacts of the energy store are located in the correct position with respect to the contacts of the gun. In other words, the systems described herein yield a reliable connection between the contacts of the energy store and the contacts of the gun while preventing the contacts from being crushed or damaged.

The retainer may include a clip that is displaced (e.g., shifted or depressed) as the energy store is inserted into the cavity and protrudes once the energy store is inserted into the cavity so as to retain the energy store within the cavity. The ejector may include a spring that is placed under load while the energy store is retained in the cavity such that the ejector forces the energy store out of the cavity in response to displacing the retainer. A lid may be used to cover the cavity and the lid may compress a gasket while in a closed position so as to seal the cavity and prevent contaminants (e.g., liquids, carbon fouling, dust, etc.) from entering the cavity. The lid may include a hinge at one end and a force dispersion mechanism at another end. An example of a force dispersion mechanism includes a lid protrusion and cavity dimple where the protrusion fits within the dimple so as to balance the hinge such that pressure is applied evenly across the gasket, thereby improving the quality of the seal and reducing the possibility of contaminants entering the cavity.

A combination of a compressible brace and a dense brace may be used to hold the energy store in a substantially static position within the cavity. The term "substantially static" may be used to indicate that the energy store moves less than a threshold amount relative to the cavity. Examples of threshold amounts include a centimeter, a micrometer, and anywhere in between. The combination of the retainer and ejector may provide a user-friendly mechanism for inserting and removing the energy store from the cavity, and the combination of the compressible brace and the dense brace may mitigate forces applied to the energy store, such as forces associated with firing the gun or dropping the gun. The dense brace (e.g., metal, alloy, dense plastic, wood, polymer, etc.) may be used to prevent the energy store from crushing the electrical contacts, and the compressible brace (e.g., foam, soft plastic, a spring, etc.) may be used to force the energy store up against the dense brace and produce a snug fit of the energy store within the cavity. The term "dense brace" may be used to describe a material that is generally not compressible. As an illustrative example, a brace that preserves 99% or more of its size under load, such as when an energy store is pushed up against it, is considered a dense brace. An example of a dense brace is a piece of glass-filled nylon. The term "compressible brace" may be used to describe a material that is generally compressible. As an illustrative example, a brace that shrinks by 2% or more (in overall size or along a dimension) under load, such as when an energy store is pushed up against it, is considered a compressible brace. An example of a compressible brace is a piece of closed-cell foam. The interior surface of the cavity may guide the energy store into place such that the electrical contacts of the energy store mate with the electrical contacts of the gun, and the interior surface of the cavity may be tapered such that the frictional load between the surface of the energy store and the surface of the cavity increases as the energy store is inserted further into the cavity, thereby facilitating the easy and reliable positioning of the energy store within the cavity.

Embodiments may be described in the context of executable instructions for the purpose of illustration. For example, a power manager housed in a gun may be described as being capable of executing instructions that facilitate charging and discharging an energy store. However, those skilled in the art will recognize that aspects of the technology could be implemented via hardware, firmware, or software. As an example, a power manager may be implemented as a power management integrated circuit (PMIC).

Terminology

References in the present disclosure to "an embodiment" or "some embodiments" means that the feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the terms "comprise," "comprising," and "comprised of" are to be construed in an inclusive sense rather than an exclusive or exhaustive sense (i.e., in the sense of "including but not limited to"). The term "based on" is also to be construed in an inclusive sense rather than an exclusive or exhaustive sense. For example, the phrase "A is based on B" does not imply that "A" is based solely on "B." Thus, the term "based on" is intended to mean "based at least in part on" unless otherwise noted.

The terms "connected," "coupled," and variants thereof are intended to include any connection or coupling between two or more elements, either direct or indirect. The connection or coupling can be physical, electrical, logical, or a combination thereof. For example, elements may be electrically or communicatively coupled with one another despite not sharing a physical connection. As one illustrative example, a first component is considered coupled with a second component when there is a conductive path between the first component and the second component. As another illustrative example, a first component is considered coupled with a second component when the first component and the second component are fastened, joined, attached, tethered, bonded, or otherwise linked.

The term "manager" may refer broadly to software, firmware, or hardware. Managers are typically functional components that generate one or more outputs based on one or more inputs. A computer program may include or utilize one or more managers. For example, a computer program may utilize multiple managers that are responsible for completing different tasks, or a computer program may utilize a single manager that is responsible for completing all tasks. As another example, a manager may include an electrical circuit that produces an output based on hardware components, such as transistors, logic gates, analog components, or digital components. Unless otherwise noted, the terms "manager" and "module" may be used interchangeably herein.

When used in reference to a list of multiple items, the term "or" is intended to cover all of the following interpretations: any of the items in the list, all of the items in the list, and any combination of items in the list. For example, the list "A, B, or C" indicates the list "A" or "B" or "C" or "A and B" or "A and C" or "B and C" or "A and B and C."

Overview of Guns

FIG. 1 illustrates an example of a gun 100 that includes a system for managing an energy store in accordance with aspects of the present disclosure. The gun 100 includes a trigger 105, a barrel 110, a magazine 115, and a magazine release 120. While these components are generally found in firearms, such as pistols, rifles, and shotguns, those skilled in the art will recognize that the technology described herein may be similarly appliable to other types of guns as discussed above. As an example, comparable components may be included in vehicle-mounted weapons that are not intended to be held or operated by hand. While not shown in FIG. 1, the gun 100 may also include a striker (e.g., a ratcheting striker or rotating striker) or a hammer that can be actuated in response to pulling the trigger 105. Pulling the trigger 105 may result in the release of the striker or hammer, thereby causing the striker or hammer to contact a firing pin, percussion cap, or primer, so as to ignite a propellant and fire a projectile through the barrel 110. Embodiments of the gun 100 may also include a blowback system, a locked breech system, or any combination thereof. These systems are more commonly found in self-reloading firearms. The blowback system may be responsible for obtaining energy from the motion of the case of the projectile as it is pushed to the rear of the gun 100 by expanding propellant, while the locked breech system may be responsible for slowing down the opening of the breech of a self-reloading firearm when fired. Accordingly, the gun 100 may support the semi-automatic firing of projectiles, the automatic firing of projectiles, or both.

The gun 100 may include one or more safeties that are meant to reduce the likelihood of an accidental discharge or an unauthorized use. The gun 100 may include one or more mechanical safeties, such as a trigger safety or a firing pin safety. The trigger safety may be incorporated in the trigger 105 to prevent the trigger 105 from moving in response to lateral forces placed on the trigger 105 or dropping the gun. The term "lateral forces," as used herein, may refer to a force that is substantially orthogonal to a central axis 145 that extends along the barrel 110 from the front to the rear of the gun 100. The firing pin safety may block the displacement path of the firing pin until the trigger 105 is pulled. Additionally or alternatively, the gun 100 may include one or more electronic safety components, such as an electronically actuated drop safety. In some cases, the gun 100 may include both mechanical and electronic safeties to reduce the potential for an accidental discharge and enhance the overall safety of the gun 100.

The gun 100 may include one or more sensors, such as a user presence sensor 125 and a biometric sensor 140. In some cases, the gun 100 may include multiple user presence sensors 125 whose outputs can collectively be used to detect the presence of a user. For example, the gun 100 may include a time of flight (TOF) sensor, a photoelectric sensor, a capacitive sensor, an inductive sensor, a force sensor, a resistive sensor, or a mechanical switch. As another example, the gun 100 may include a proximity sensor that is configured to emit an electromagnetic field or electromagnetic radiation, like infrared, and looks for changes in the field or return signal. As another example, the gun 100 may include an inertial measurement unit (IMU) configured to identify a presence event in response to measuring movement that matches a movement signature of a user picking up the gun 100. As another example, the gun 100 may include an audio input mechanism (e.g., a transducer implemented in a microphone) that is configured to generate a signal that is representative of nearby sounds, and the presence of the user can be detected based on an analysis of the signal.

The gun 100 may also include one or more biometric sensors 140 as shown in FIG. 1. For example, the gun 100 may include a fingerprint scanner (also referred to as a "fingerprint scanner"), an image sensor, or an audio input mechanism. The fingerprint scanner may generate a digital image (or simply "image") of the fingerprint pattern of the user, and the fingerprint pattern can be examined (e.g., on the gun 100 or elsewhere) to determine whether the user should be verified. The image sensor may generate an image of an anatomical feature (e.g., the face or eye) of the user, and the image can be examined (e.g., on the gun 100 or elsewhere) to determine whether the user should be verified. Normally, the image sensor is a charge-coupled device (CCD) or complementary metal-oxide semiconductor (CMOS) sensor that is included in a camera module (or simply "camera") able to generate color images. The image sensor need not necessarily generate images in color, however. In some embodiments, the image sensor is configured to generate ultraviolet, infrared, or near infrared images. Regardless of its nature, images generated by the image sensor can be used to authenticate the presence or identity of the user. As an example, an image generated by a camera may be used to perform facial recognition of the user. The audio input mechanism may generate a signal that is representative of audio containing the voice of the user, and the signal can be examined (e.g., on the gun 100 or elsewhere) to determine whether the user should be verified. Thus, the signal generated by the audio input mechanism may be used to perform speaker recognition of the user. Including multiple biometric sensors in the gun 100 may support a robust authentication procedure that functions in the event of sensor failure, thereby improving gun reliability. Note, however, that each of the multiple biometric sensors may not provide the same degree or confidence of identity verification. As an example, the output produced by one biometric sensor (e.g., an audio input mechanism) may be used to determine whether a user is present while the output produced by another biometric sensor (e.g., a fingerprint scanner or image sensor) may be used to verify the identity of the user in response to a determination that the user is present.

The gun 100 may include one or more components that facilitate the collection and processing of token data. For example, the gun 100 may include an integrated circuit (also referred to as a "chip") that facilitates wireless communication. The chip may be capable of receiving a digital identifier, such as a Bluetooth® token or a Near Field Communication (NFC) identifier. The term "authentication data" may be used to described data that is used to authenticate a user. For example, the gun 100 may collect authentication data from the user to determine that the user is authorized to operate the gun 100, and the gun 100 may be unlocked based on determining that the user is authorized to operate the gun 100. Authentication data may include biometric data, token data, or both. Authentication data may be referred to as enrollment data when used to enroll a user, and authentication data may be referred to as query data when used to authenticate a user. In some examples, the gun may transform (e.g., encrypt, hash, transform, encode, etc.) enrollment data and store the transformed enrollment data in memory (e.g., non-volatile memory) of the gun, and the gun may discard or refrain from storing query data in the memory. Thus, the gun 100 may transform authentication data, so as to inhibit unauthenticated use even in the event of unauthorized access of the gun.

The gun 100 may support various types of aiming sights (or simply "sights"). At a high level, a sight is an aiming device that may be used to assist in visually aligning the gun 100 (and, more specifically, its barrel 110) with a target. For example, the gun 100 may include iron sights that improve aim without the use of optics. Additionally or alternatively, the gun 100 may include telescopic sights, reflex sights, or laser sights. In FIG. 1, the gun 100 includes two sights—namely, a front sight 130 and a rear sight 135. In some cases, the front sight 130 or the rear sight 135 may be used to indicate gun state information. For example, the front sight 130 may include a single illuminant that is able to emit light of different colors to indicate different gun states. As another example, the front sight 130 may include multiple illuminants, each of which is able to emit light of a different color, that collectively are able to indicate different gun states. One example of an illuminant is a light-emitting diode (LED).

The gun 100 may fire projectiles, and the projectiles may be associated with lethal force or less-lethal force. For example, the gun 100 may fire projectiles containing lead, brass, copper, zinc, steel, plastic, rubber, synthetic polymers (e.g., nylon), or a combination thereof. In some examples, the gun 100 is configured to fire lethal bullets containing lead, while in other cases the gun 100 is configured to fire less-lethal bullets containing rubber. As mentioned above, the technology described herein may also be used in the context of a gun that fires prongs (also referred to as "darts") which are intended to contact or puncture the skin of a target and then carry electric current into the body of the target. These guns are commonly referred to as "electronic control weapons" or "electroshock weapons." One example of an electroshock weapon is a TASER device.

As further discussed herein, the gun 100 may include a system for managing an energy store (e.g., a battery, a battery pack, a capacitor, a capacitor bank, a fuel cell, etc.). The system may produce a reliable connection between the energy store and the gun while also mitigating the potential adverse effects that contaminants (e.g., water, oil, solvents, carbon fouling, etc.) can have on the energy store. The system may include an energy store located inside a cavity of the gun, and the energy store may be configured to discharge electric charge across a physical coupling of an electrical contact of the energy store and a complementary electrical contact of the gun. The electric charge discharged by the energy store may be used to power electronic components of the gun and/or to cause the gun to discharge projectiles. The system may include a dense brace located at a lower end of the cavity, where a width of the dense brace is larger than a width of the electrical contact of the energy store. The system may also include a compressible brace located at an upper end of the cavity, where the compressible brace is configured to press against the energy store such that the energy store is braced between the compressible brace and the dense brace. The gun 100 may include a lid that is configured to close an aperture of the cavity, and a brace (e.g., a dense brace or a compressible brace) may be affixed to the lid such that the brace contacts the energy store while the lid is in a closed position.

Figure 2:
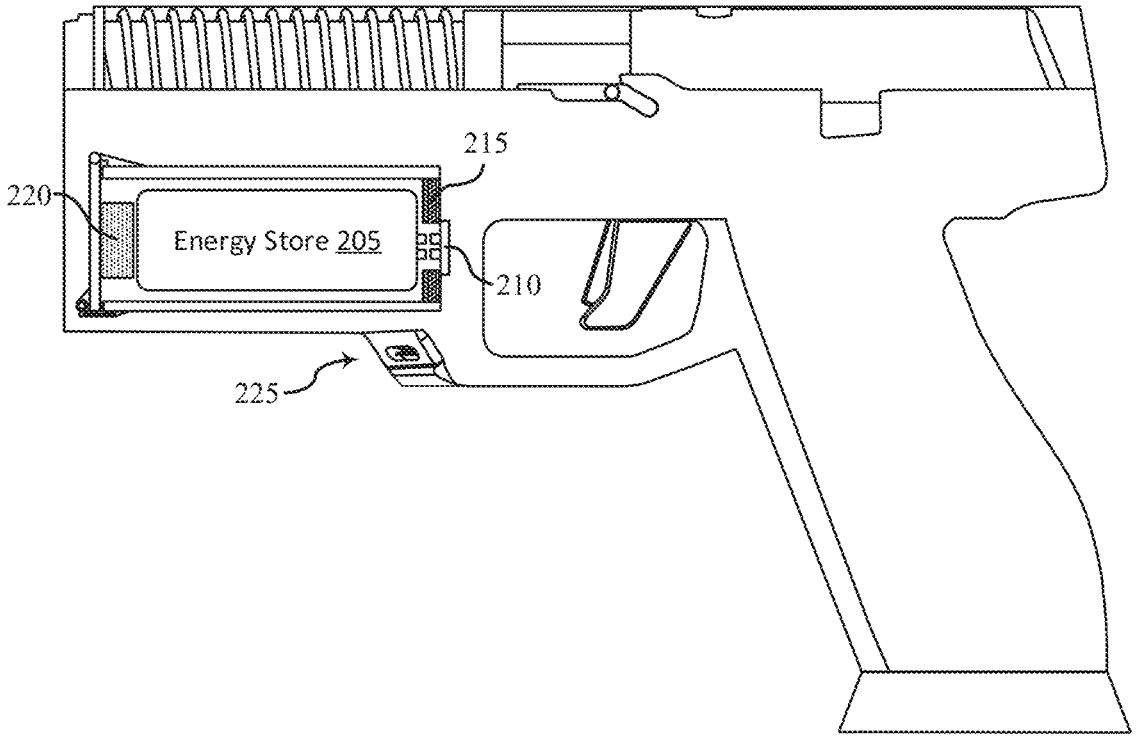
FIG. 2 illustrates an example of a gun that includes an energy store and a system for managing the energy store.

FIG. 2 illustrates an example of a gun 200 that includes an energy store 205 and a system for managing the energy store 205. Aspects of the system for managing the energy store 205 include electrical contacts 210, a dense brace 215, and a compressible brace 220. FIG. 2 illustrates the energy store 205 located within a cavity of the gun 200 that is located below the barrel and forward of the trigger.

In some examples, the energy store 205 may include a battery pack, and the battery pack may include lithium-ion cells, lithium-ion polymer cells, lithium cobalt cells, lithium manganese, lithium phosphate, lithium titanate, lithium-thionyl chloride, nickel cadmium, nickel-metal hydride, zinc-carbon, lead-acid, alkaline, or the like. In some other examples, the energy store 205 may include a capacitor bank. The energy store 205 may deliver energy to the gun 200 via the electrical contacts 210. The electrical contacts 210 may include positive and negative terminals such that electrons can flow from the energy store 205 to the gun 200, powering one or more components of the gun 200. In some examples, the electrical contacts 210 may include spring contacts, copper contacts, a universal serial bus (USB) interface, or the like.

The gun 200 includes a dense brace 215 and a compressible brace 220. The compressible brace 220 may be affixed to the lid of the cavity, and the energy store 205 may be held between the compressible brace 220 and the dense brace 215 such that an electrical connection is formed at the electrical contacts 210.

The gun 200 includes an interface 225, which may be used to charge the energy store 205. In some cases, the energy store 205 may provide energy to peripheral devices, such as a display panel or flashlight, via the interface 225. In other words, the energy store 205 may be used as an energy sink and/or an energy source. In some examples, the interface 225 may be a USB interface, such as a USB Type-C interface.

Figure 3:
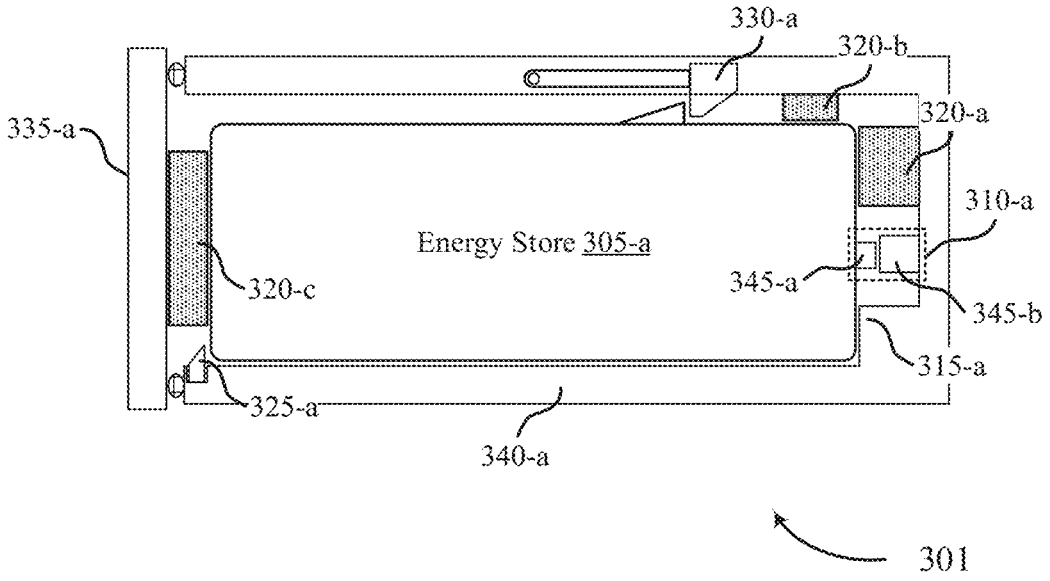
FIG. 3 illustrates examples of systems for managing an energy store.
Figure 3:
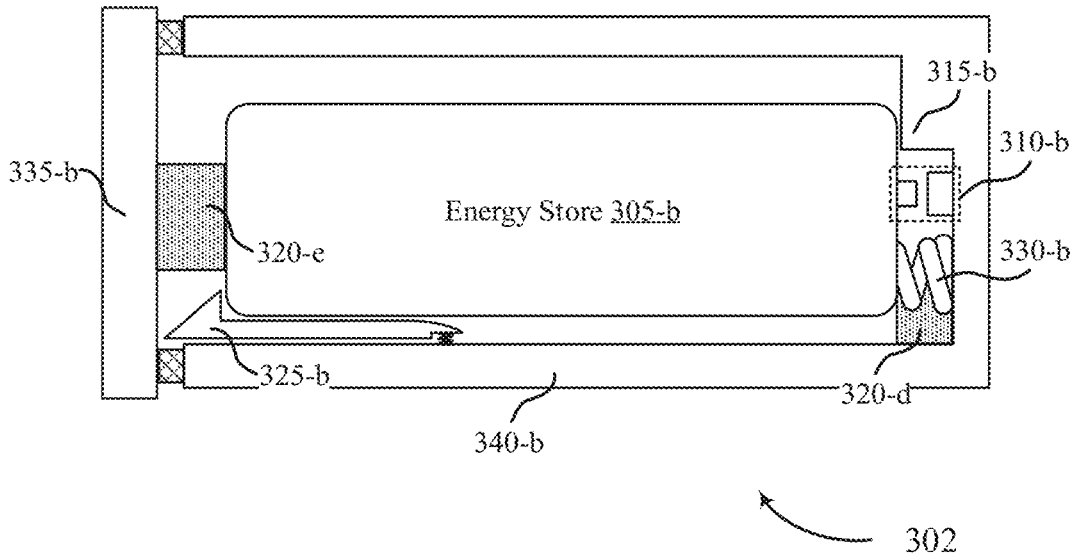

FIG. 3 illustrates an example of a system 301 for managing an energy store and a system 302 for managing an energy store. Aspects of a system for managing an energy store may be included in a gun, such as the gun 100 described with reference to FIG. 1 and/or the gun 200 described with reference to FIG. 2.

The system 301 includes an energy store 305-*a* positioned inside a cavity 340-*a*, and the energy store 305-*a* may be configured to provide energy via the contacts 310-*a*. The dense brace 315-*a* creates a hard stop that prevents the energy store 305-*a* from damaging the contacts 310-*a* while keeping the energy store 305-*a* secured in place. In some examples, the dense brace 315-*a* may be plastic, metal, allow, wood, or the like. The compressible brace 320-*a*, the compressible brace 320-*b*, and the compressible brace 320-*c* may be used to secure the energy store 305-*a* in place. The compressible braces may guide the energy store 305-*a* in place as the energy store 305-*a* is inserted into the cavity, and the compressible braces may absorb forces associated with firing the gun, thereby providing a robust and reliable connection between the energy store 305-*a* and the gun.

The contacts 310-*a* include an electrical contact 345-*a* of the energy store 305-*a* and a complementary electrical contact 345-*b*. The complementary electrical contact 345-*b* may be an electrical contact of the cavity 340-*a*. In some examples, the complementary electrical contact 345-*b* may be an electrical contact of a gun. The contacts 310-*a* may include, for example, laminated button contacts, sintered contacts, and metallized carbon contacts.

The retainer 325-*a* may retain the energy store 305-*a* in place. For example, the retainer 325-*a* may retain the energy store 305-*a* inside the cavity 340-*a* such that an electrical connection is formed between the contacts 310-*a* and energy can be transferred from the energy store 305-*a* to the gun. The retainer 325-*a* may be spring loaded. For example, the exterior surface of the retainer 325-*a* may be angled such that inserting the energy store 305-*a* compresses the spring and depresses the retainer 325-*a*, and the retainer 325-*a* may extend upward once the energy store 305-*a* is inserted into the cavity 340-*a*. The retainer 325-*a* may contact the energy store 305-*a* and hold the energy store 305-*a* within the cavity 340-*a*.

The ejector 330-*a* may eject the energy store 305-*a* partially or fully from the cavity 340-*a*. For example, to remove the energy store 305-*a* from the cavity 340-*a*, the retainer 325-*a* may be depressed, and the ejector 330-*a* may eject the energy store 305-*a* from the cavity 340-*a* such that at least a portion of the energy store 305-*a* is exposed and outside of the cavity 340-*a*. In some examples, the ejector 330-*a* may include a spring, the spring may experience load while the energy store 305-*a* is inside the cavity 340-*a* with the lid 335-*a* closed, and the ejector 330-*a* may eject the energy store 305-*a* based on the lid 335-*a* being opened and/or based on the retainer 325-*a* being depressed.

The system 302 illustrates another example of a system for managing an energy store. Aspects of the system 302, or aspects of the system 301 may be implemented in a gun to facilitate a reliable and robust connection between the energy store and the gun.

The energy store 305-*b* is positioned inside the cavity 340-*b*, and the energy store 305-*b* may be configured to provide energy via the contacts 310-*b*. The dense brace 315-*b* creates a hard stop, while the compressible brace 320-*d* and the compressible brace 320-*e* may be used to secure the energy store 305-*b* in place within the cavity 340-*b*.

The retainer 325-*b* may retain the energy store 305-*b* in place, and the ejector 330-*b* may eject the energy store 305-*b* from the cavity 340-*b*. In some examples, the ejector 330-*b* may include a spring, the spring may experience load while the energy store 305-*b* is inside the cavity 340-*b* with the lid 335-*b* closed, and the ejector 330-*b* may eject the energy store 305-*b* from the cavity 340-*b* based on the lid 335-*b* being opened and/or based on the retainer 325-*b* being depressed. The retainer 325-*b* may hold the energy store 305-*a* in place within the cavity 340-*b* and the lid 335-*b* may secure the energy store 305-*a* in place within the cavity 340-*b* such that a reliable connection is maintained by the contacts 310-*b*. The contacts 310-*b* may be an example of electrical contacts, such as conductive alloy or metal.

Figure 4:
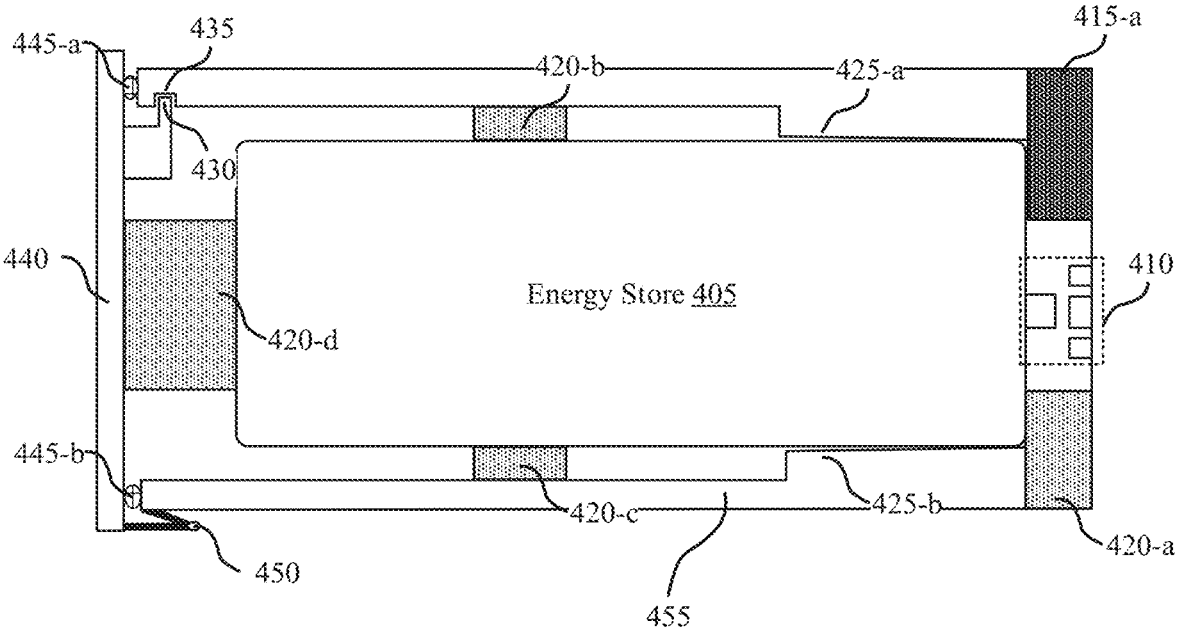
FIG. 4 illustrates an example of a system for securely retaining an energy store in a cavity of a gun.

FIG. 4 illustrates an example of a system 400 for securely retaining an energy store in a cavity of a gun. Aspects of the system 400 may be implemented in a gun to manage the energy store 405, and the energy store 405 may provide energy to the gun via the contacts 410.

The system 400 may include dense braces and/or compressible braces. For example, the energy store 405 may contact the dense brace 415-*a*, the compressible brace 420-*a*, the compressible brace 420-*b*, the compressible brace 420-*c*, and the compressible brace 420-*d*. The dense brace 415-*a* may act as a hard stop that prevents the energy store 405 from crushing or damaging the contacts 410, and the compressible brace 420-*a*, the compressible brace 420-*b*, the compressible brace 420-*c*, or the compressible brace 420-*d* may support the energy store 405 and keep the energy store 405 in place.

In some examples, the cavity 455 may include a tapered interior edge 425-*a* and a tapered interior edge 425-*b*. The tapered interior edges facilitate a reliable connection by the contacts 410 and prevent undesired displacement of the energy store 405. The tapered interior edge 425-*a* and the tapered interior edge 425-*b* facilitate a snug fit of the energy store 405 inside the cavity 455 while avoiding a fit that is too tight, which may damage the energy store 405 or produce a poor user experience where the customer has difficulty inserting and/or removing the energy store 405 from the cavity 455.

The lid 440 facilitates a proper positioning of the energy store 405 within the cavity 455 while also keeping contaminants outside of the cavity 455, thereby preventing contaminants from damaging or interfering with the contacts 410 and improving system reliability. Closing the lid 440 results in the cavity 455 being sealed. For example, the gasket 445-*a* and the gasket 445-*b* may be used to produce a seal between the lid 440 and the cavity 455 that prevents contaminates, such as dust, carbon fouling, water, or oil from entering the cavity 455 and potentially damaging the energy store 405 or the contacts 410. The gasket 445-*a* and the gasket 445-*b* may refer to a single gasket, or the gasket 445-*a* may refer to a first gasket and the gasket 445-*b* may refer to a second gasket.

The closure mechanism 450 (which may also be referred to as a "hinge mechanism") may be used to open and close the lid 440. The closure mechanism 450 may include a hinge, a spring, a tab, or the like. The system 400 includes a protrusion 430 and a corresponding dimple 435. The combination of the protrusion 430 and the dimple 435 may be referred to as a "force dispersion mechanism." The protrusion 430 and the dimple 435 may be located opposite of the closure mechanism 450 to facilitate an even and reliable seal. For example, the protrusion 430 may fit inside the dimple 435 and act as a hinge that balances force generated by the closure mechanism 450, thereby producing a seal that is snug and even. The combination of the closure mechanism 450 and the protrusion 430 and the dimple 435 (also referred to as a "balancing mechanism") ensures that force is applied evenly across the gasket 445-*a* and the gasket 445-*b* while the lid 440 is closed, thereby enhancing the reliability of the seal and preventing unwanted ingress of contaminates into the cavity 455. FIG. 4 illustrates the protrusion 430 as part of the lid 440 and the dimple 435 as part of an interior edge of the cavity 455, but it should be understood that the protrusion 430 may be part of the interior edge of the cavity 455 and the dimple 435 may be part of the lid 440.

Figure 5:
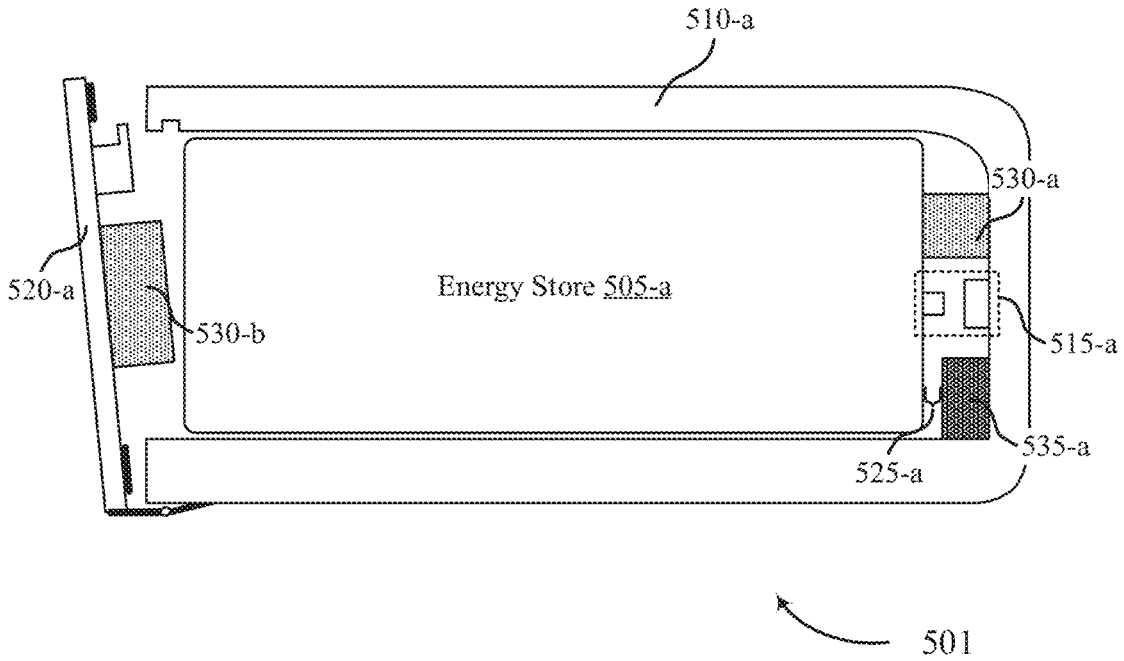
FIG. 5 illustrates examples of systems that seal an aperture of a cavity containing an energy store so as to mitigate potential contaminants.
Figure 5:
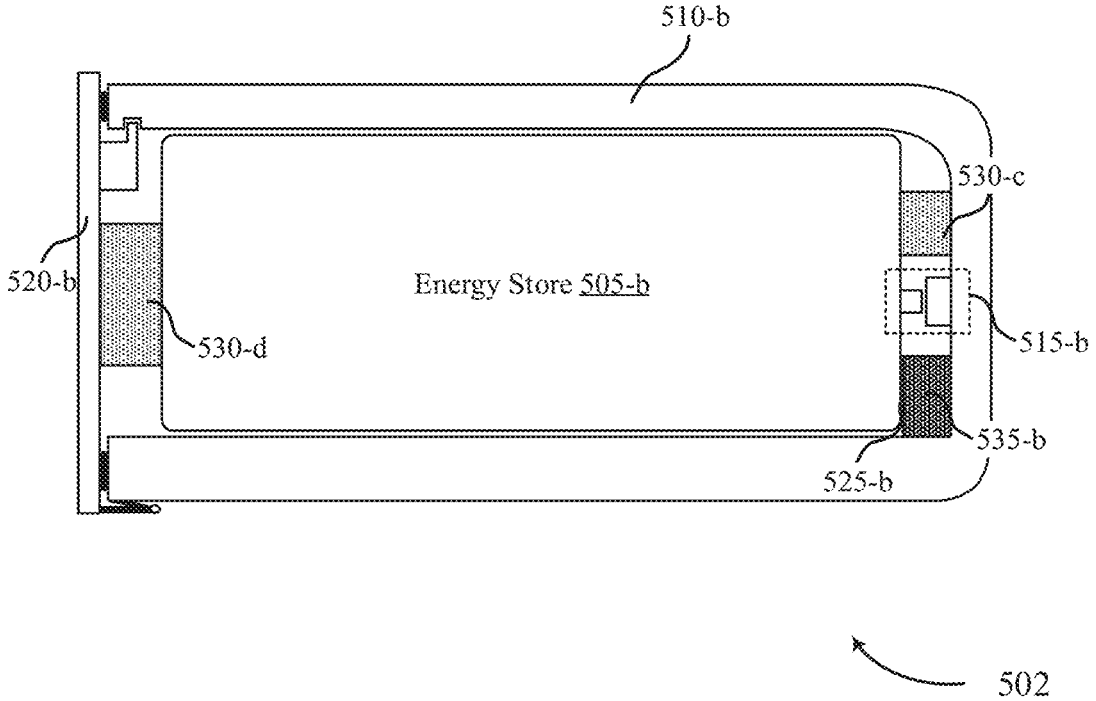

FIG. 5 illustrates an example of a system 501 for sealing an aperture of a cavity and a system 502 for sealing an aperture of a cavity. A cavity may be an aspect of a gun, and the cavity may be configured to house an energy store.

The system 501 illustrates an example of a lid 520-*a* in an open position. The system 501 includes an energy store 505-*a*, a cavity 510-*a*, contacts 515-*a*, the lid 520-*a*, a dense brace 535-*a*, a compressible brace 530-*a*, and a compressible brace 530-*b*. The system 501 also includes a gap 525-*a*. The gap 525-*a* is between the energy store 505-*a* and the dense brace 535-*a*. The gap 525-*a* may be a result of the lid 520-*a* being open.

The system 502 illustrates a lid 520-*b* in a closed position. The system 502 includes an energy store 505-*b*, a cavity 510-*b*, contacts 515-*b*, the lid 520-*b*, a dense brace 535-*b*, a compressible brace 530-*c*, and a compressible brace 530-*d*.

As a result of the lid 520-*b* being in a closed position, the gap 525-*b* is smaller than the gap 525-*a*, or the gap 525-*b* is eliminated. For example, as a result of the lid 520-*b* being closed, the energy store 505-*b* is seated inside the cavity 510-*b* such that the energy store 505-*b* is contacting the dense brace 535-*b*. Closing the lid 520-*b* such that the gap 525-*b* is eliminated and the energy store 505-*b* is in contact with the dense brace 535-*b* mitigates undesired movement of the energy store 505-*b* and prevents the energy store 505-*b* from damaging the contacts 515-*b*. In some examples, the width of the dense brace 535-*b* may be larger than the width of the contacts 515-*b* so as to prevent the energy store 505-*b* from sliding into, and potentially damaging, the contacts 515-*b*.

Figure 6:
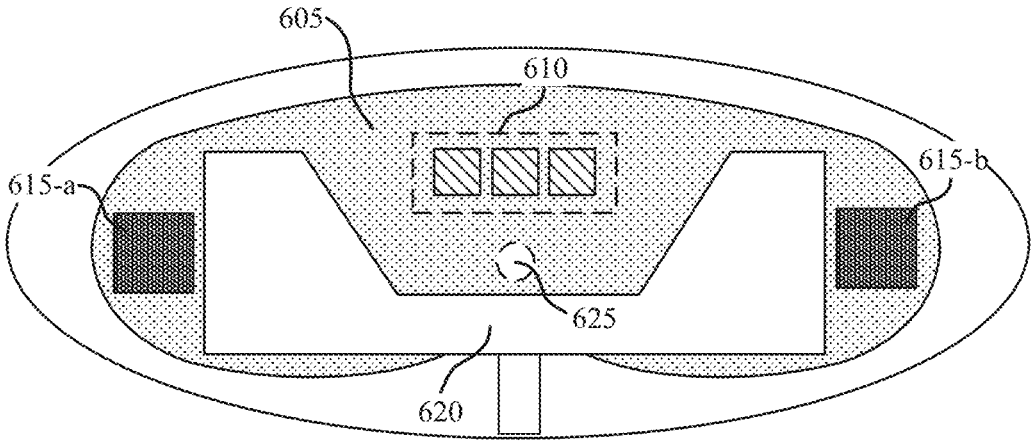
FIG. 6 illustrates an example of a rear view of a system for managing an energy store.

FIG. 6 illustrates an example of a rear view of a system 600 for managing an energy store. The system 600 may be an aspect of a gun described herein.

The system 600 includes an energy store 605, contacts 610, a brace 615-*a*, a brace 615-*b*, and an ejection mechanism 620. The brace 615-*a* and the brace 615-*b* may both be compressible braces, dense braces, or a combination of dense braces and compressible braces. For example, the brace 615-*a* may be a compressible brace and the brace 615-*b* may be a dense brace. The ejection mechanism 620 may be used to eject the energy store 605 from a cavity. For example, the ejection mechanism 620 may include a spring applies force to the energy store 605 so as to push the energy store 605 partially or fully out of the cavity. The system 600 includes a longitudinal axis 625 which may be parallel with a bore axis of the barrel of the gun.

Figure 7:
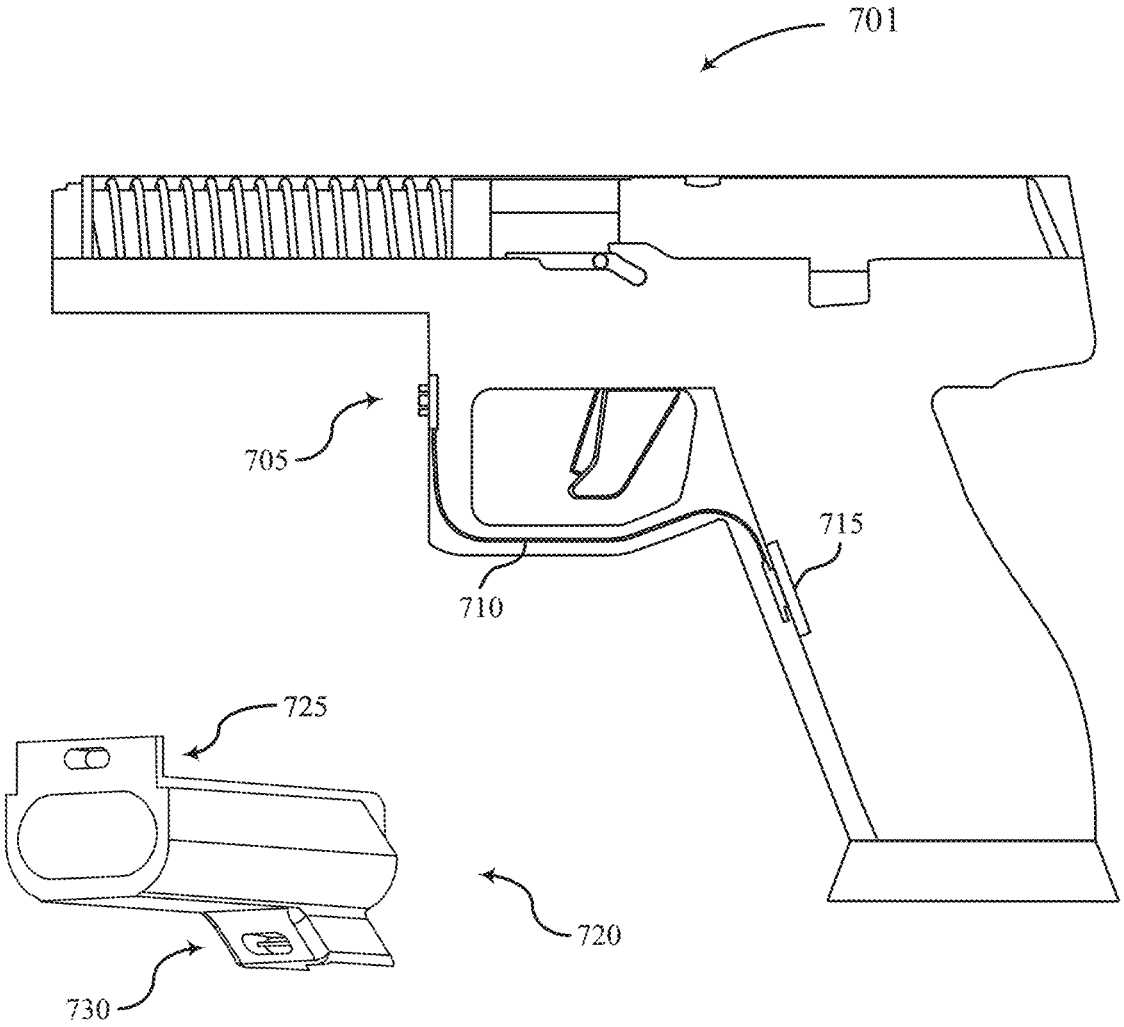
FIG. 7 illustrates an example of a gun and an example of an energy store management system.

FIG. 7 illustrates an example of a gun 701 that includes, or can be coupled with, an energy store management system 720.

The gun 701 includes electrical contacts 705, an electrical channel 710, and an electrical component 715. The electrical contacts 705 may be configured to mate with corresponding electrical contacts of the energy store management system 720 such that electric charge can flow from the energy store management system 720 to the gun 701.

The energy store management system 720 may support the management of an energy store, such as a battery pack. The energy store managed via the energy store management system 720 may provide power to the electrical component 715 via the electrical channel 710. The electrical channel 710 may function as a power channel and/or a data channel. For example, the electrical channel 710 may support a communication protocol, such as an inter-integrated circuit (I2C) protocol, a serial peripheral interface (SPI) protocol, or a universal asynchronous reception and transmission (UART) protocol. As another example, the electrical channel 710 may support a power delivery protocol, such as USB-PD. The gun 701 may support charging the energy store according to a USB-PD protocol. The electrical channel 710 may support the transmission of electrical signals and/or data packets.

The electrical interface 725 may include electrical contacts that are configured to mate with the electrical contacts 705 of the gun 701. In some examples, the electrical interface 725 may provide an electrical connection between the energy store management system 720 and the gun 701, and the electrical interface 730 may provide an electrical connection between the gun 701 and a peripheral component, such as a charger, a docking station, a portable configuration device, a smartphone, a computer, or the like.

The electrical interface 730 supports coupling a peripheral device with the gun 701. For example, the electrical interface 730 may facilitate the coupling with a USB cord, thereby allowing the peripheral USB cord to charge the gun 701 and/or the energy store housed in the energy store management system 720. The electrical interface 730 may support charging the energy store according to a USB-PD protocol. For example, the gun 701 may include a power management integrated circuit that facilitates charging the energy store according to the USB-PD protocol. The power management integrated circuit may be an example of a power manager described herein.

In some examples, the electrical channel 710 may be routed through the trigger guard of the gun 701, which may improve the space utilization efficiency and therefore the design and ergonomics of the gun 701.

Figure 8:
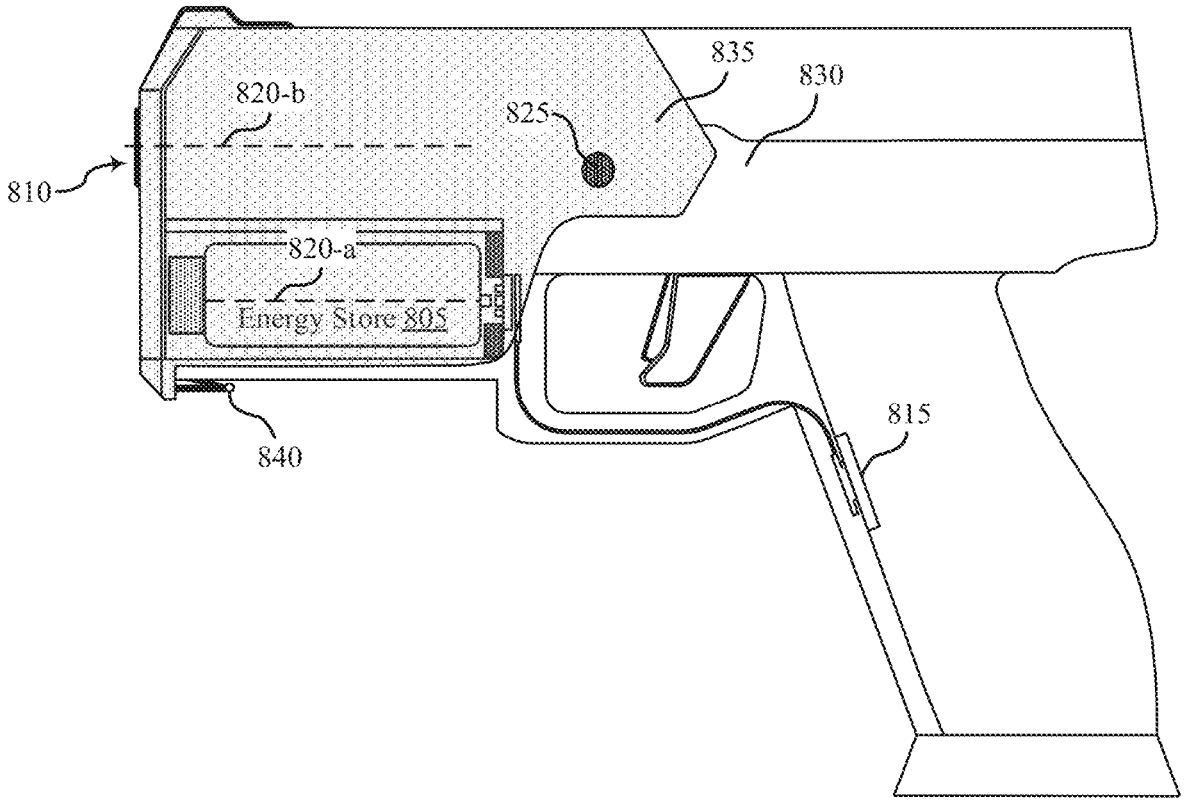
FIG. 8 illustrates an example of a gun that includes a system for managing an energy store.

FIG. 8 illustrates an example of a gun 800 that includes a system for managing an energy store. The gun 800 includes an energy store 805, a barrel 810, an electrical component 815, a longitudinal axis 820-*a* of the energy store 805, a bore axis 820-*b* of the barrel 810, a retaining pin 825, a frame 830, an attachment 835, and a hinge mechanism 840.

The systems described herein facilitate a robust and reliable connection between the energy store 805 and the gun 800. The energy store 805 may be located inside a cavity of the gun 800. The longitudinal axis 820-*a* may be substantially parallel with the bore axis 820-*b*, and the system for managing the energy store 805 mitigates the recoil force associated with firing the gun 800 so as to maintain a reliable electrical connection between the energy store 805 and the gun 800. Contributing factors for mitigating the recoil force include the use of tapered interior edges of the cavity, the use of dense braces, and the use of compressible braces.

In some examples, the attachment 835 may function as a lid for an aperture of the cavity. For example, a portion of the attachment 835 may function as the lid 520-*a* or the lid 520-*b* as described with reference to FIG. 5, the lid 440 as described with reference to FIG. 4, the lid 335-*a* or the lid 335-*b* as descried with reference to FIG. 3, etc. For example, the hinge mechanism 840 may secure the attachment 835 over the energy store cavity. In some cases, the retaining pin 825 (e.g., a takedown lever) may mechanically couple the attachment 835 with the frame 830. For example, the retaining pin 825 may couple the attachment 835 with the frame 830, and the hinge mechanism 840 may secure the attachment 835 over the energy store cavity so as to form a seal and block contaminates from entering the energy store cavity. In some examples, the gun 800 may not include the hinge mechanism 840, and the retaining pin 825 may couple the attachment 835 with the frame 830, and the attachment 835 may seal the aperture of the cavity.

Figure 9:
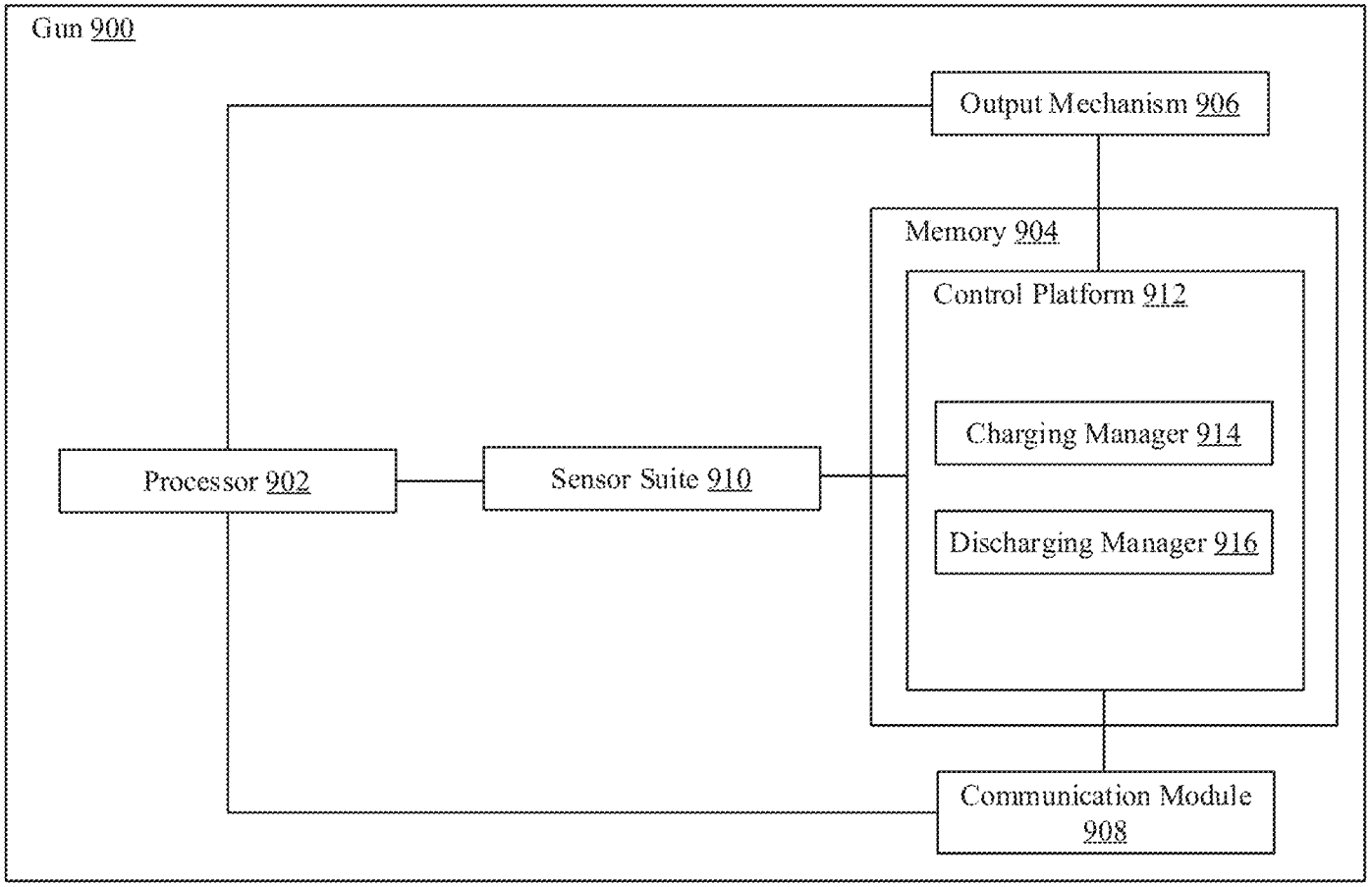
FIG. 9 illustrates an example of a gun that supports managing an energy store.

FIG. 9 illustrates an example of a gun 900 able to implement a control platform 912 designed to produce outputs that are helpful in ensuring the gun 900 is used in an appropriate manner. As further discussed below, the control platform 912 (also referred to as a "management platform" or a "power manager") may be designed to manage the charging and discharging of an energy store.

In some embodiments, the control platform 912 is embodied as a computer program that is executed by the gun 900. In other embodiments, the control platform 912 is embodied as an electrical circuit that performs logical operations of the gun 900. In yet other embodiments, the control platform 912 is embodied as a computer program that is executed by a computing device to which the gun 900 is communicatively connected. In such embodiments, the gun 900 may transmit relevant information to the computing device for processing as further discussed below. Those skilled in the art will recognize that aspects of the computer program could also be distributed amongst the gun 900 and computing device.

The gun 900 can include a processor 902, memory 904, output mechanism 906, and communication manager 908. The processor 902 can have generic characteristics similar to general-purpose processors, or the processor 902 may be an application-specific integrated circuit (ASIC) that provides control functions to the gun 900. As shown in FIG. 9, the processor 902 can be coupled with all components of the gun 900, either directly or indirectly, for communication purposes.

The memory 904 may be comprised of any suitable type of storage medium, such as static random-access memory (SRAM), dynamic random-access memory (DRAM), electrically erasable programmable read-only memory (EEPROM), flash memory, or registers. In addition to storing instructions that can be executed by the processor 902, the memory 904 can also store data generated by the processor 902 (e.g., when executing the managers of the control platform 912). Note that the memory 904 is merely an abstract representation of a storage environment. The memory 904 could be comprised of actual memory chips or managers.

The output mechanism 906 can be any component that is capable of conveying information to a user of the gun 900. For example, the output mechanism 906 may be a display panel (or simply "display") that includes LEDs, organic LEDs, liquid crystal elements, or electrophoretic elements. Alternatively, the display may simply be a series of illuminants (e.g., LEDs) that are able to indicate the status of the gun 900. Thus, the display may indicate whether the gun 900 is presently in a locked state, unlocked state, etc. As another example, the output mechanism 906 may be a loudspeaker (or simply "speaker") that is able to audibly convey information to the user.

The communication manager 908 may be responsible for managing communications between the components of the gun 900. Additionally or alternatively, the communication manager 908 may be responsible for managing communications with computing devices that are external to the gun 900. Examples of computing devices include mobile phones, tablet computers, wearable electronic devices (e.g., fitness trackers), and network-accessible server systems comprised of computer servers. Accordingly, the communication manager 908 may be wireless communication circuitry that is able to establish communication channels with computing devices. Examples of wireless communication circuitry include integrated circuits (also referred to as "chips") configured for Bluetooth, Wi-Fi®, NFC, and the like.

Sensors are normally implemented in the gun 900. Collectively, these sensors may be referred to as the "sensor suite" 910 of the gun 900. For example, the gun 900 may include a motion sensor whose output is indicative of motion of the gun 900 as a whole. Examples of motion sensors include multi-axis accelerometers and gyroscopes. As another example, the gun 900 may include a proximity sensor whose output is indicative of proximity of the gun 900 to a nearest obstruction within the field of view of the proximity sensor. A proximity sensor may include, for example, an emitter that is able to emit infrared (IR) light and a detector that is able to detect reflected IR light that is returned toward the proximity sensor. These types of proximity sensors are sometimes called laser imaging, detection, and ranging (LiDAR) scanners. As another example, the gun 900 may include a fingerprint sensor or camera that generates images which can be used for, for example, biometric authentication. As shown in FIG. 9, outputs produced by the sensor suite 910 may be provided to the control platform 912 for examination or analysis.

For convenience, the control platform 912 may be referred to as a computer program that resides in the memory 904. However, the control platform 912 could be comprised of software, firmware, or hardware components that are implemented in, or accessible to, the gun 900. In accordance with embodiments described herein, the control platform 912 may include a charging manager 914 and a discharging manager 916. As an illustrative example, the discharging manager 916 may monitor the discharge of electric charge by an energy store by processing data generated by a voltage integrator.

Figure 10:
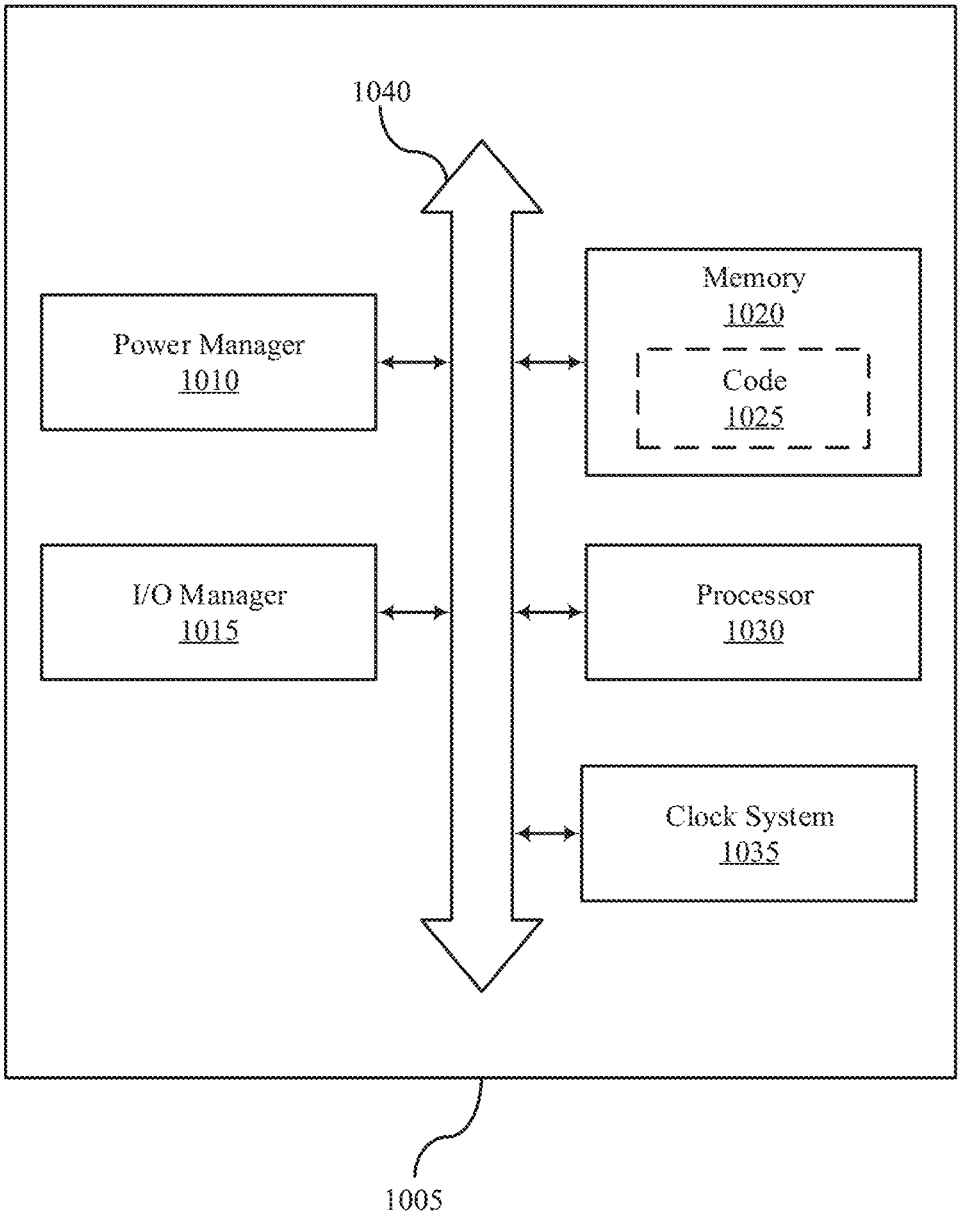
FIG. 10 illustrates an example of a system that supports managing an energy store.

FIG. 10 illustrates an example of a system 1000 that supports managing an energy store. The device 1005 may be operable to implement the techniques, technology, or systems disclosed herein. The device 1005 may include components such as a power manager 1010, an input/output (I/O) manager 1015, memory 1020, code 1025, a processor 1030, a clock system 1035, and a bus 1040. The components of the device 1005 may communicate via one or more buses 1040. The device 1005 may be an example of, or include components of, a gun, a firearm, or a firing mechanism.

The power manager 1010 may include an integrated circuit that facilitates the implementation of a power protocol, such as a USB-PD protocol. The power manager 1010 may facilitate the charging of an energy store, the discharging of an energy store, or the monitoring of an energy store. In some examples, the power manager 1010 may measure the voltage of the energy store and/or calculate the amount of ampere hours remaining in the energy store. The power manager 1010 may determine that the amount of electric charge (or ampere hours) remaining in the energy store is less than a threshold, and the power manager 1010 may generate a notification (e.g., an audible notification, a visual notification, a tactile notification, etc.) in response to determining that the amount of electric charge is less than the threshold.

The I/O manager 1015 may manage input and output signals for the device 1005. The I/O manager 1015 may also manage various peripherals such an input device (e.g., a button, a switch, a touch screen, a dock, a biometric sensor, a pressure sensor, a heat sensor, a proximity sensor, an RFID sensor, etc.) and an output device (e.g., a monitor, a display, an LED, a speaker, a haptic motor, a heat pipe, etc.).

The memory 1020 may include or store code (e.g., software) 1025. The memory 1020 may include volatile memory, such as random-access memory (RAM) and/or non-volatile memory, such as read-only memory (ROM). The code 1025 may be computer-readable and computer-executable, and when executed, the code 1025 may cause the processor 1030 to perform various operations or functions described here.

The processor 1030 may be an example or component of a central processing unit (CPU), an application specific integrated circuit (ASIC), or a field programmable gate array (FPGA). In some embodiments, the processor 1030 may utilize an operating system or software such as Microsoft Windows®, iOS®, Android®, Linux®, Unix®, or the like. The clock system 1035 can control a timer for use by the disclosed embodiments.

The power manager 1010, or its sub-components, may be implemented in hardware, software (e.g., software or firmware) executed by a processor, or a combination thereof. The power manager 1010, or its sub-components, may be physically located in various positions. For example, in some cases, the power manager 1010, or its sub-components may be distributed such that portions of functions are implemented at different physical locations by one or more physical components.

Figure 11:
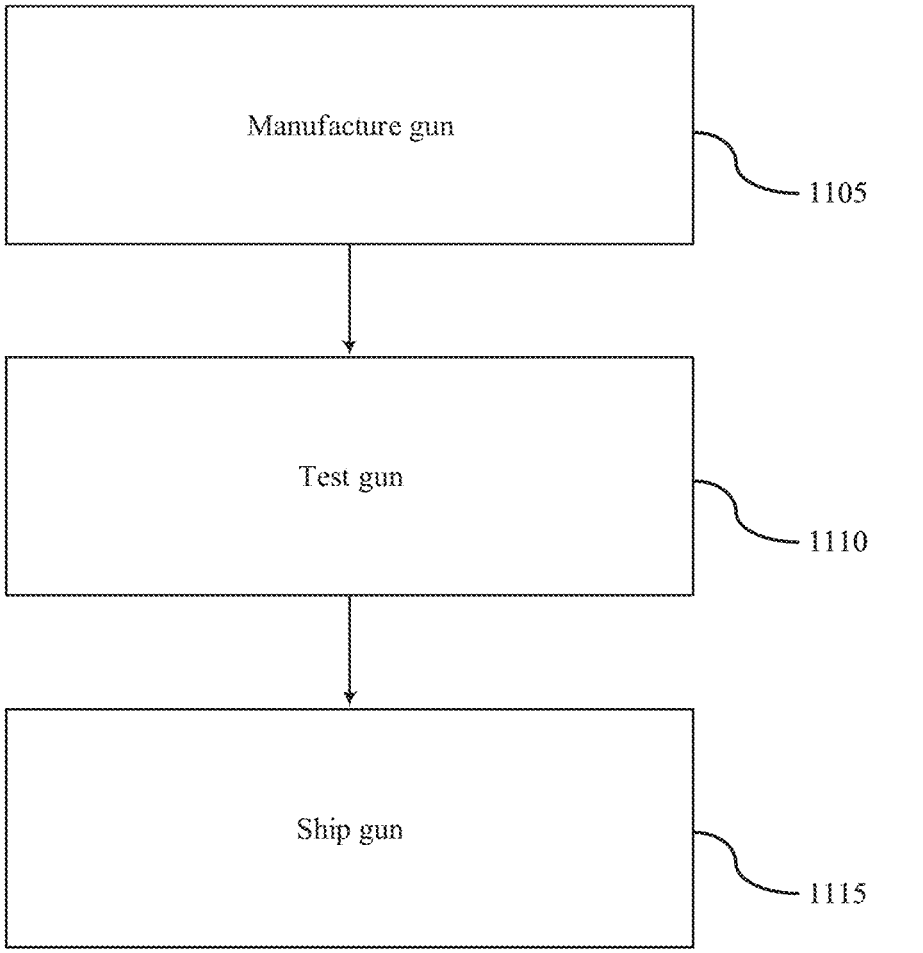
FIG. 11 illustrates an example of a flowchart showing a method of manufacturing a gun that includes an energy store management system.

FIG. 11 illustrates an example of a flowchart 1100 showing a method of manufacturing a gun that includes an energy store management system. Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Initially, a gun manufacturer (or simply "manufacturer") may manufacture a gun that is able to implement aspects of the present disclosure (step 1105). For example, the manufacturer may machine, cut, shape, or otherwise make parts to be included in the gun. Thus, the manufacturer may also design those parts before machining occurs, or the manufacturer may verify designs produced by another entity before machining occurs. Additionally or alternatively, the manufacturer may obtain parts that are manufactured by one or more other entities. Thus, the manufacturer may manufacture the gun from components produced entirely by the manufacturer, components produced by other entities, or a combination thereof. Often, the manufacturer will obtain some parts and make other parts that are assembled together to form the gun (or a component of the gun).

The manufacturer may develop an energy store management system. The energy store management system may be configured for a particular model of gun, or the energy store management system may be configured to work with various different types of guns. The manufacturer may test the energy store management system in isolation and/or in the context of a gun. For example, the manufacturer may verify the dimensions of the energy store management system in isolation before verifying the strength of the energy store management system in the context of the gun. The manufacturer may also test the charging and discharging performance of the energy store. For example, the manufacturer may test a power manager to verify the charge time of the energy store.

In some embodiments, the manufacturer also generates identifying information related to the gun. For example, the manufacturer may etch (e.g., mechanically or chemically), engrave, or otherwise append identifying information onto the gun itself. As another example, the manufacturer may encode at least some identifying information into a data structure that is associated with the gun. For instance, the manufacturer may etch a serial number onto the gun, and the manufacturer may also populate the serial number (and other identifying information) into a data structure for recording or tracking purposes. Examples of identifying information include the make of the gun, the model of the gun, the serial number, the type of projectiles used by the gun, the caliber of those projectiles, the type of firearm, the barrel length, and the like. In some cases, the manufacturer may record a limited amount of identifying information (e.g., only the make, model, and serial number), while in other cases the manufacturer may record a larger amount of identifying information.

The manufacturer may then test the gun (step 1110). In some embodiments, the manufacturer tests all of the guns that are manufactured. In other embodiments, the manufacturer tests a subset of the guns that are manufactured. For example, the manufacturer may randomly or semi-randomly select guns for testing, or the manufacturer may select guns for testing in accordance with a predefined pattern (e.g., one test per 5 guns, 10 guns, or 100 guns). Moreover, the manufacturer may test the gun in its entirety, or the manufacturer may test a subset of its components. For example, the manufacturer may test the component(s) that it manufactures. As another example, the manufacturer may test newly designed components or randomly selected components. Thus, the manufacturer could test select component(s) of the gun, or the manufacturer could test the gun as a whole. For example, the manufacturer may test the barrel to verify that it meets a precision threshold and the cartridge feed system to verify that it meets a reliability threshold. As another example, the manufacturer may test a group of guns (e.g., all guns manufactured during an interval of time, guns selected at random over an interval of time, etc.) to ensure that those guns fire at a sufficiently high pressure (e.g., 70,000 pounds per square inch (PSI)) to verify that a safety threshold is met.

Thereafter, the manufacturer may ship the gun to a dealer (step 1115). In the event that the gun is a firearm, the manufacturer may ship the gun to a Federal Firearms Licensed (FFL) dealer. For example, a purchaser (also referred to as a "customer") may purchase the apparatus through a digital channel or non-digital channel. Examples of digital channels include web browsers, mobile applications, and desktop applications, while examples of non-digital channels include ordering via the telephone and ordering via a physical storefront. In such a scenario, the gun may be shipped to the FFL dealer so that the purchaser can obtain the gun from the FFL dealer. The FFL dealer may be directly or indirectly associated with the manufacturer of the gun. For example, the FFL dealer may be a representative of the manufacturer, or the FFL dealer may sell and distribute guns on behalf of the manufacturer (and possibly other manufacturers).

Note that while the sequences of the steps performed in the processes described herein are exemplary, the steps can be performed in various sequences and combinations. For example, steps could be added to, or removed from, these processes. Similarly, steps could be replaced or reordered. As an example, the manufacturer may iteratively test components while manufacturing the gun, and therefore perform multiple iterations of steps 1105 and 1110 either sequentially or simultaneously (e.g., one component may be tested while another component is added to the gun). Thus, the descriptions of these processes are intended to be open ended.

EXAMPLES

Several aspects of the present disclosure are set forth examples. Note that, unless otherwise specified, all of these examples can be combined with one another. Accordingly, while a feature may be described in the context of a given example, the feature may be similarly applicable to other examples.

In some examples, the techniques described herein relate to a gun including: a trigger that is operable to cause the gun to propel projectiles through a barrel of the gun; an energy store located inside a cavity of the gun, wherein the energy store is configured to discharge electric charge across a physical coupling of an electrical contact of the energy store and a complementary electrical contact of the gun, and wherein the electric charge is used to cause the gun to propel projectiles through the barrel; a dense brace located at a lower end of the cavity, wherein a width of the dense brace is larger than a width of the electrical contact of the energy store; a compressible brace located at an upper end of the cavity, wherein the compressible brace is configured to press against the energy store such that the energy store is braced between the compressible brace and the dense brace; and a physical electrical interface located on an exterior surface of the gun, wherein the physical electrical interface is configured to provide a mechanism for charging the energy store.

In some examples, the techniques described herein relate to a gun including: a trigger that is operable to cause the gun to propel projectiles through a barrel of the gun; an energy store located inside a cavity of the gun, wherein the energy store is configured to discharge electric charge across a physical coupling of an electrical contact of the energy store and a complementary electrical contact of the gun; a first brace located at a lower end of the cavity; and a second brace located at an upper end of the cavity.

In some examples, the techniques described herein relate to a gun, wherein the first brace comprises a dense brace. In some examples, the dense brace is formed of glass-filled nylon. In some examples, the dense brace is formed of metal-alloy.

In some examples, the techniques described herein relate to a gun, wherein the first brace comprises a compressible brace. In some examples, the compressible brace is formed of closed-cell foam.

In examples, the techniques described herein relate to a gun, wherein the second brace comprises a compressible brace. In some examples, the compressible brace is formed of closed-cell foam.

In examples, the techniques described herein relate to a gun, wherein the second brace comprises a dense brace. In some examples, the dense brace is formed of glass-filled nylon. In some examples, the dense brace is formed of metal-alloy.

In some examples, the techniques described herein relate to a gun including: an energy store located inside a cavity of the gun, wherein the energy store is configured to discharge electric charge across a physical coupling of an electrical contact of the energy store and a complementary electrical contact of the gun, and wherein the electric charge is used to cause the gun to discharge projectiles; a dense brace located at a lower end of the cavity, wherein a width of the dense brace is larger than a width of the electrical contact of the energy store; and a compressible brace located at an upper end of the cavity, wherein the compressible brace is configured to press against the energy store such that the energy store is braced between the compressible brace and the dense brace.

In some examples, the techniques described herein relate to a gun, further including: a physical electrical interface located on an exterior surface of the gun, wherein the physical electrical interface is configured to provide a mechanism for charging the energy store.

In some examples, the techniques described herein relate to a gun, further including: a retaining mechanism configured to contact the energy store so as to retain the energy store inside the cavity.

In some examples, the techniques described herein relate to a gun, wherein the retaining mechanism is further configured to retain the energy store such that the electrical contact of the energy store is in contact with the complementary electrical contact of the gun.

In some examples, the techniques described herein relate to a gun, further including: an ejection mechanism configured to apply force onto the energy store so as to bias the energy store away from a lower end of the cavity.

In some examples, the techniques described herein relate to a gun, wherein the ejection mechanism is configured to eject the energy store from the cavity based on disengagement of a retaining mechanism.

In some examples, the techniques described herein relate to a gun, further including: a gasket located at an upper end of the cavity, wherein the gasket is configured to seal the cavity when a cavity lid is closed and in contact with the gasket.

In some examples, the techniques described herein relate to a gun, further including: a force dispersion mechanism configured to disperse force across the gasket.

In some examples, the techniques described herein relate to a gun, further including: a hinge mechanism that is coupled with a cavity lid, wherein the hinge mechanism is operable to position the cavity lid over an aperture of the cavity.

In some examples, the techniques described herein relate to a gun, further including: a lid mechanism including the compressible brace.

In some examples, the techniques described herein relate to a gun, further including: a physical electrical channel embedded in a trigger guard of the gun, wherein the physical electrical channel couples the energy store with an electrical component of the gun.

In some examples, the techniques described herein relate to a gun, wherein the cavity is tapered such that a lower end of the cavity is narrower than an upper end of the cavity.

In some examples, the techniques described herein relate to a gun, wherein a width of the dense brace is larger than a width of the electrical contact of the energy store.

In some examples, the techniques described herein relate to a gun, wherein an axis of the energy store is parallel to a bore axis of the gun.

In some examples, the techniques described herein relate to a gun, wherein an axis of the energy store is perpendicular to a bore axis of the gun.

In some examples, the techniques described herein relate to a gun including: an energy store located inside a cavity of the gun, wherein the energy store is configured to discharge electric charge across a physical coupling of an electrical contact of the energy store and a complementary electrical contact of the gun; a retaining mechanism configured to hold the energy store inside the cavity such that a constant connection is maintained between the electrical contact of the energy store and the complementary electrical contact of the gun; and a sealing mechanism capable of assuming (i) an open position and (ii) a closed position, wherein the sealing mechanism is configured to prevent contaminates from entering the cavity of the gun while assuming the closed position. In some examples, the means for retaining the energy store is a lid, a cap, a compressible brace, or a dense brace. In some examples, the means for retaining the energy store is lid fastened to a gun with a hinge. In some examples, the means for retaining the energy store is lid fastened to a gun with a pin. In some examples, the sealing mechanism is a gasket, an O-ring, or liquid adhesive. In some examples, the sealing mechanism is ultrasonic welding or elastomeric over-molding.

In some examples, the techniques described herein relate to a gun, further including: a physical electrical interface located on an exterior surface of the gun, wherein the physical electrical interface is configured to provide a mechanism for charging the energy store.

In some examples, the techniques described herein relate to a gun, wherein the physical electrical interface includes a universal serial bus interface.

In some examples, the techniques described herein relate to a gun, further including: a trigger that is operable to cause the energy store to discharge electric charge into an actuator of the gun, wherein the actuator is configured to be displaced in response to the electric charge, and wherein the displacement of the actuator results in a projectile being propelled through a barrel of the gun.

Remarks

The Detailed Description provided herein, in connection with the drawings, describes example configurations and does not represent all the examples that may be implemented or that are within the scope of the claims. The term "example" used herein means "serving as an illustration or instance," and not "a preferred example."

The functions described herein may be implemented with a controller. A controller may include a power manager, a special-purpose processor, a general-purpose processor, a digital signal processor (DSP), a CPU, a graphics processing unit (GPU), a microprocessor, a tensor processing unit (TPU), a neural processing unit (NPU), an image signal processor (ISP), a hardware security module (HSM), an ASIC, a programmable logic device (such as an FPGA), a state machine, a circuit (such as a circuit including discrete hardware components, analog components, or digital components), or any combination thereof. Some aspects of a controller may be programmable, while other aspects of a control may not be programmable. In some examples, a digital component of a controller may be programmable (such as a CPU), and in some other examples, an analog component of a controller may not be programmable (such as a differential amplifier).

In some cases, instructions or code for the functions described herein may be stored on or transmitted over a computer-readable medium, and components implementing the functions may be physically located at various locations. Computer-readable media includes both non-transitory computer storage media and communication media. A non-transitory storage medium may be any available medium that may be accessed by a computer or component. For example, non-transitory computer-readable media may include RAM, SRAM, DRAM, ROM, EEPROM, flash memory, magnetic storage devices, or any other non-transitory medium that may be used to carry and/or store program code means in the form of instructions and/or data structures. The instructions and/or data structures may be accessed by a special-purpose processor, a general-purpose processor, a manager, or a controller. A computer-readable media may include any combination of the above, and a compute component may include computer-readable media.

In the context of the specification, the term "left" means the left side of the gun when the gun is held in an upright position, where the term "upright position" generally refers to a scenario in which the gun is oriented as if in a high-ready position with the barrel roughly parallel to the ground. The term "right" means the right side of the gun when the gun is held in the upright position. The term "front" means the muzzle end (also referred to as the "distal end") of the gun, and the term "back" means the grip end (also referred to as the "proximal end") of the gun. The terms "top" and "bottom" mean the top and bottom of the gun as the gun is held in the upright position. The relative positioning terms such as "left," "right," "front," and "rear" are used to describe the relative position of components. The relative positioning terms are not intended to be limiting relative to a gravitational orientation, as the relative positioning terms are intended to be understood in relation to other components of the gun, in the context of the drawings, or in the context of the upright position described above.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

What is claimed is:

1. A gun comprising:

a trigger that is operable to cause the gun to propel projectiles through a barrel of the gun;

an energy store located inside a cavity of the gun, wherein the energy store is configured to discharge electric charge across a physical coupling of an electrical contact of the energy store and a complementary electrical contact of the gun, and wherein the electric charge is used to cause the gun to propel the projectiles through the barrel;

a dense brace located at a lower end of the cavity, wherein a width of the dense brace is larger than a width of the electrical contact of the energy store;

a compressible brace located at an upper end of the cavity, wherein the compressible brace is configured to press against the energy store such that the energy store is braced between the compressible brace and the dense brace; and a physical electrical interface located on an exterior surface of the gun, wherein the physical electrical interface supports a power delivery protocol that is configured for charging the energy store.

2. A gun comprising:

an energy store located inside a cavity of the gun, wherein the energy store is configured to be (i) inserted into the cavity along a longitudinal axis that is parallel with a bore axis of the gun and (ii) removed from the cavity along the longitudinal axis, wherein the energy store is configured to discharge electric charge across a physical coupling of an electrical contact of the energy store and a complementary electrical contact of the gun, and wherein the electric charge is used to cause the gun to discharge projectiles;

a dense brace located at a lower end of the cavity, wherein a width of the dense brace is larger than a width of the electrical contact of the energy store; and a compressible brace located at an upper end of the cavity, wherein the compressible brace is configured to press against the energy store and compress along the longitudinal axis such that the energy store is braced between the compressible brace and the dense brace.

3. The gun of claim 2, further comprising:

a physical electrical interface located on an exterior surface of the gun, wherein the physical electrical interface supports a power delivery protocol that is configured for charging the energy store.

4. The gun of claim 2, further comprising:

a retaining mechanism configured to contact the energy store so as to retain the energy store inside the cavity.

5. The gun of claim 4, wherein the retaining mechanism is further configured to retain the energy store such that the electrical contact of the energy store is in contact with the complementary electrical contact of the gun.

6. The gun of claim 2, further comprising:

an ejection mechanism configured to apply force onto the energy store so as to bias the energy store away from the lower end of the cavity.

7. The gun of claim 6, wherein the ejection mechanism is configured to eject the energy store from the cavity based on disengagement of a retaining mechanism.

8. The gun of claim 2, further comprising:

a gasket located at the upper end of the cavity, wherein the gasket is configured to seal the cavity when a cavity lid is closed and in contact with the gasket.

9. The gun of claim 8, further comprising:

a force dispersion mechanism configured to disperse force across the gasket.

10. The gun of claim 2, further comprising:

a hinge mechanism that is coupled with a cavity lid, wherein the hinge mechanism is operable to position the cavity lid over an aperture of the cavity.

11. The gun of claim 2, further comprising:

a lid mechanism comprising the compressible brace.

12. The gun of claim 2, further comprising:

a physical electrical channel embedded in a trigger guard of the gun, wherein the physical electrical channel couples the energy store with an electrical component of the gun.

13. The gun of claim 2, wherein the cavity is tapered such that the lower end of the cavity is narrower than the upper end of the cavity.

14. The gun of claim 2, wherein the width of the dense brace is smaller than a width of the compressible brace.

15. The gun of claim 2, wherein an axis of the energy store is parallel to the bore axis of the gun.

16. The gun of claim 2, wherein an axis of the energy store is perpendicular to the bore axis of the gun.

17. A gun comprising:

an energy store located inside a cavity of the gun, wherein the energy store is configured to be (i) inserted into the cavity along a longitudinal axis that is parallel with a bore axis of the gun and (ii) removed from the cavity along the longitudinal axis, wherein the energy store is configured to discharge electric charge across a physical coupling of an electrical contact of the energy store and a complementary electrical contact of the gun;

means for retaining the energy store inside the cavity such that a constant connection is maintained between the electrical contact of the energy store and the complementary electrical contact of the gun; and a sealing mechanism capable of assuming (i) an open position and (ii) a closed position, wherein the sealing mechanism applies force onto the energy store along the longitudinal axis that is parallel with the bore axis of the gun and is configured to prevent contaminates from entering the cavity of the gun while assuming the closed position.

18. The gun of claim 17, further comprising:

a physical electrical interface located on an exterior surface of the gun, wherein the physical electrical interface supports a power delivery protocol that is configured for charging the energy store.

19. The gun of claim 18, wherein the physical electrical interface comprises a universal serial bus interface.

20. The gun of claim 17, further comprising:

a trigger that is operable to cause the energy store to discharge the electric charge into an actuator of the gun, wherein the actuator is configured to be displaced in response to the electric charge, and wherein displacement of the actuator results in a projectile being propelled through a barrel of the gun.

* * * * *